United States Patent [19]

Dutt et al.

[11] Patent Number: 4,747,511

[45] Date of Patent: May 31, 1988

[54] PLUG-TYPE OPENERS FOR PLASTIC CAN ENDS

[75] Inventors: Herbert V. Dutt; Donald F. Yeager, both of Sarasota; Dixie L. Weir, Brandenton, all of Fla.

[73] Assignee: Sun Coast Plastics, Inc., Sarasota, Fla.

[21] Appl. No.: 884,136

[22] Filed: Jul. 10, 1986

[51] Int. Cl.[4] ..... B65D 39/00

[52] U.S. Cl. ..... 220/307; 220/270; 220/271; 220/260; 220/375

[58] Field of Search ..... 220/270, 271, 307, 375, 220/260, 254

[56] References Cited

U.S. PATENT DOCUMENTS

| | | | |
|---|---|---|---|
| Re. 26,453 | 5/1961 | Edwards . | |
| 2,207,757 | 10/1936 | Reardon . | |
| 2,400,851 | 4/1946 | Morikawa et al. . | |
| 2,662,656 | 12/1953 | Beaubaire et al. . | |
| 2,770,383 | 2/1956 | Livas . | |
| 3,119,509 | 11/1961 | Livesay et al. . | |
| 3,281,024 | 10/1966 | Henchert et al. . | |
| 3,462,048 | 8/1969 | Henchert . | |
| 3,731,835 | 5/1973 | Hawkins et al. | 220/307 |
| 3,737,066 | 6/1973 | Ames | 220/254 |
| 3,797,689 | 3/1974 | Adonaitis . | |
| 3,807,595 | 4/1974 | Zundel . | |
| 3,869,059 | 3/1975 | Ellis . | |
| 3,904,071 | 9/1975 | Stearns . | |
| 3,905,502 | 9/1975 | Wassilieff . | |
| 3,927,805 | 12/1975 | Stull . | |
| 4,002,516 | 1/1977 | Gaborieau et al. . | |
| 4,043,474 | 8/1977 | McCord | 220/307 |
| 4,065,017 | 12/1977 | Burton . | |
| 4,157,764 | 6/1979 | Moller . | |
| 4,171,062 | 10/1979 | Allen et al. . | |
| 4,211,336 | 7/1980 | Helms . | |
| 4,280,634 | 7/1981 | Wiesenberger et al. . | |
| 4,315,578 | 2/1982 | Ludwig, Jr. . | |
| 4,328,906 | 5/1982 | Walter . | |
| 4,393,979 | 7/1983 | Ball et al. . | |
| 4,407,424 | 10/1983 | Heyn . | |

*Primary Examiner*—George T. Hall

*Attorney, Agent, or Firm*—Jones, Tullar & Cooper

[57] ABSTRACT

An easy-open lid for an all-plastic beverage can is disclosed, the easy-open feature including a removable closure plug secured in a dispensing aperture formed in the lid of the can. A pull tab is secured to the closure plug for removal of the entire plug.

16 Claims, 8 Drawing Sheets

FIG. 12
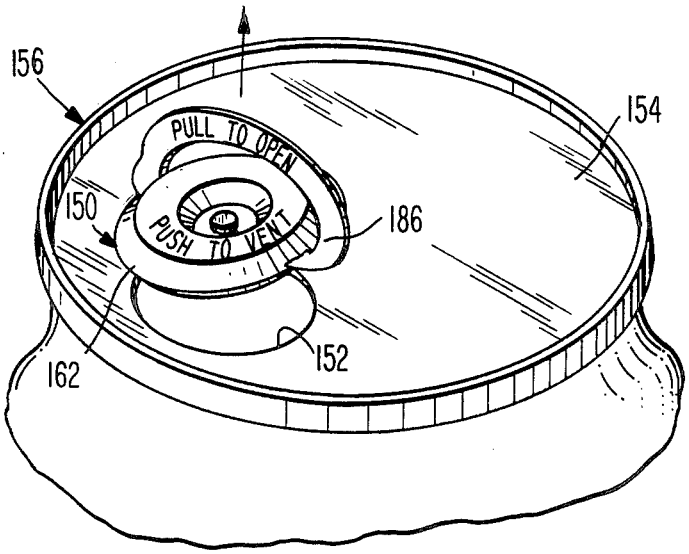
FIG. 13
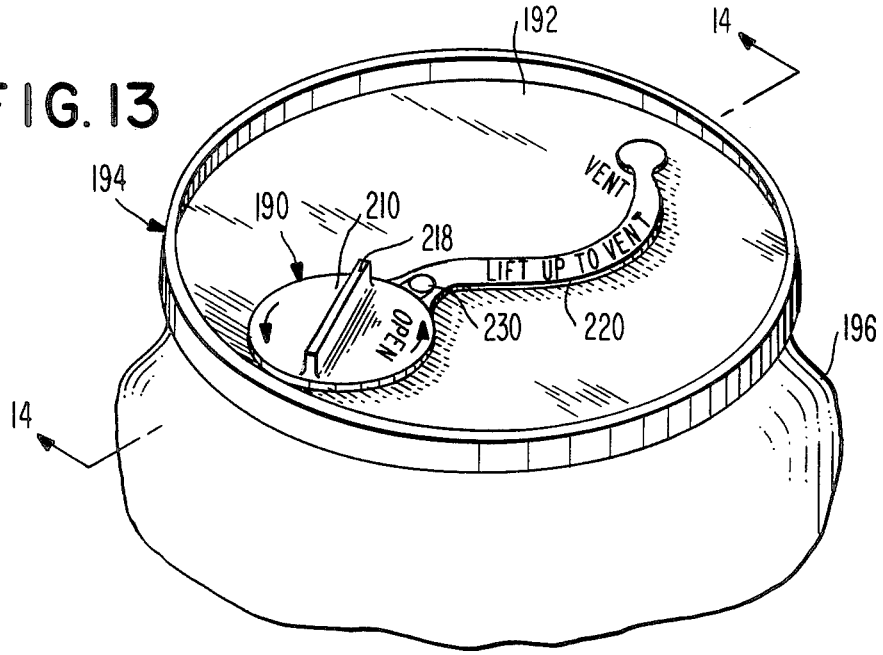
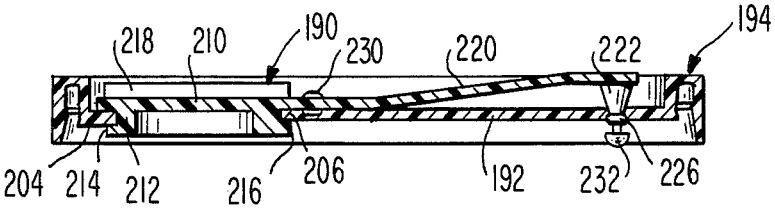
FIG. 14

FIG. 18
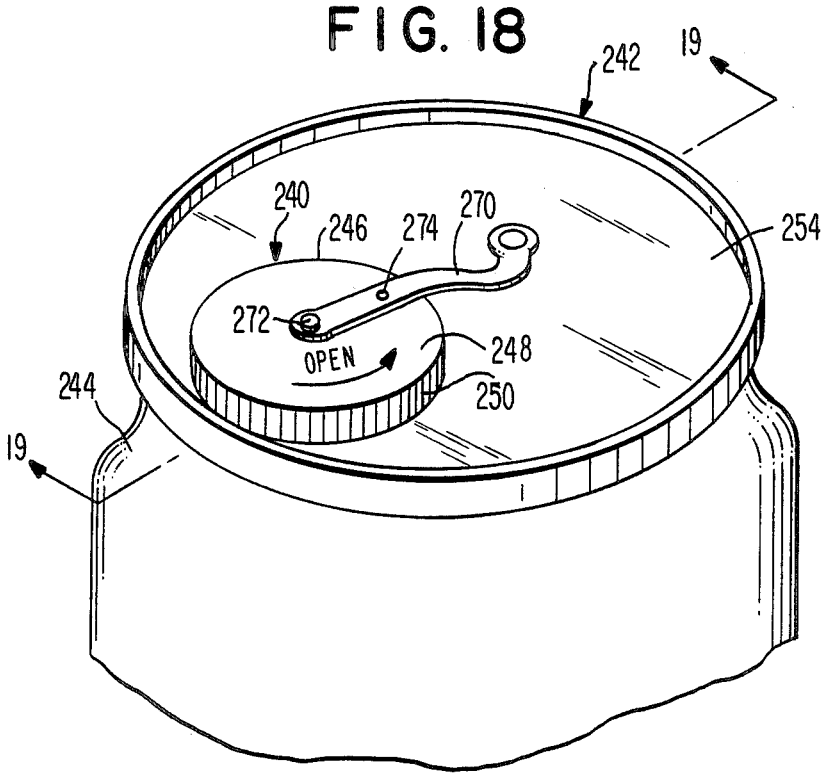
FIG. 19
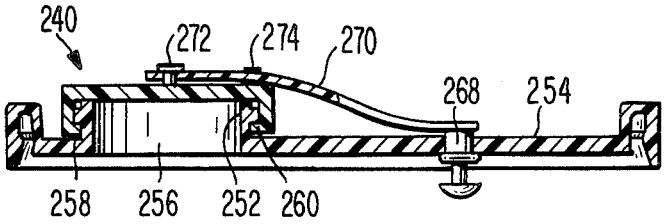
FIG. 21
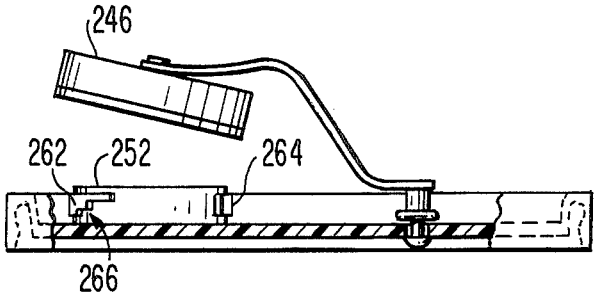
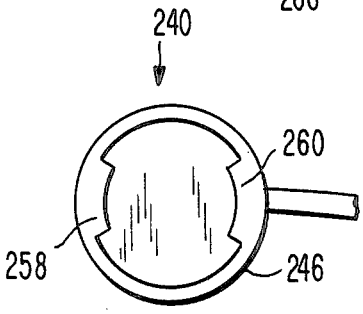
FIG. 20
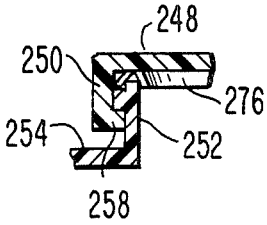
FIG. 22

PLUG-TYPE OPENERS FOR PLASTIC CAN ENDS

BACKGROUND OF THE INVENTION

The present invention relates, in general, to ends for containers. More particularly, the invention relates to openers for such container ends, and in particular to the so-called easy-open type of openers for beverage containers.

Recent advances in the beverage container field have led to the development of all-plastic containers which are commonly referred to as plastic cans, and which have been shown by test marketing to meet with wide consumer acceptance. Although metal cans have long been in use for packaging soft drinks and like carbonated beverages, plastic cans provide a number of advantages.

A "plastic can" may take a variety of shapes, and may be of any desired size, but generally is a cylindrical, wide-mouthed container capable of holding about 12 fluid ounces and is formed of a plastic material such as polypropylene, polycarbonate, polyvinyl chloride (PVC), polyethylene terephthalate (PET), or the like, with PET being the preferred material. Such a plastic has the strength required to withstand the pressures, of up to about 100 psi, which can be generated by a carbonated beverage, limits the permeation, or leakage, of carbon dioxide so that beverages will have a long shelf life, and does not require the internal coating which is needed by metal containers to avoid adverse effects on the taste of the contents. Such a plastic container may be transparent or translucent, and has the consequent marketing advantage of enabling customers to see what they are buying. Further, such a container has good thermal insulating qualities, so that the container does not feel as cold to the touch as does a metal container when the contents are chilled. The body portion of a container of this type is closed at the bottom by a concave, spherical bottom wall to provide the required strength characteristics, and has a wide mouth at the top, preferably extending across substantially the entire diameter of the container, which must be closed after the container is filled.

Initially, such containers were closed with a metal closure of the type referred to as a can "end", which was preferably of aluminum and which was similar to the ends commonly used on metal beverage cans. Such container ends were applied to the upper edge of the plastic body portion by a crimping process after the application of a sealant material between the end and the container. One of the advantages of such a metal end was the ability to utilize a conventional "pop-top" or tear-away opener of the type conventionally used on aluminum beverage cans. However, such ends also had a number of problems. First, the crimping of the ends onto the container involved a multi-step process which was expensive and time consuming. Further, the combination of a metal end with a plastic container was deemed by many to be aesthetically unappealing. Finally, the use of a metal end on a plastic container significantly increased the cost of recycling the container, for the end had to be removed from the can so that the two materials could be separately handled in the recycling process. Since the recycling of materials has become an environmental concern as well as an important factor in the cost of a container, the provision of a container end closure formed of a single material is highly desirable.

The solution to the problem of providing a satisfactory plastic closure for a plastic can was difficult, for it was necessary to devise an end which would be easy to install, which would provide a secure seal, and which would withstand the high pressures generated by carbonated beverages, over a long shelf life. Such an end had to be readily assembled onto the container by automatic machinery and would have to remain in place even during rough handling. In the preferred form, the end would require no sealing material between it and the can, and should provide a closure of the same material as the body of the can.

The solution to the problem of providing a plastic end for a plastic container was solved by the invention disclosed in U.S. application Ser. No. 824,983 of Herbert V. Dutt, filed Jan. 23, 1986, and assigned to the assignee of the present application, the disclosure of which is hereby incorporated herein by reference. As therein described, the top edge of the container is flared outwardly and downwardly to form in cross-section an inverted V shape, with the free end of the curved portion forming a locking flange which extends continuously around the outer periphery of the container. The top edge of the can lies in a horizontal plane which is perpendicular to the vertical axis of the side wall of the container, and the locking flange extends radially outwardly and downwardly at an angle of about 60°–70° from that plane. The plastic closure, or end, is formed from the same material as the body of the container, both of which preferably are formed of PET. The end is shaped to provide a transparent or translucent, dome-shaped concave top wall for the container when the end and can are assembled. The end includes a peripheral, upstanding rim which is curved downwardly and outwardly to define a locking groove adapted to snap over the peripheral top edge of the container side wall and to engage the locking flange. The locking groove is generally in the shape of an inverted V in cross-section to engage to top peripheral edge of the container body. When assembled, the locking groove receives the entire top edge of the container, with the groove and the locking flange of the can cooperating to form an interlocking joint between the two components of the can. The locking flange and the locking groove are so dimensioned as to produce an inward flexing of the container flange as the end is applied, with the flange snapping outwardly over a locking bead formed within the downwardly facing locking groove of the end to hold the end in position.

Although the closure described above provides a simple, snap-on assembly which seals the container and which is capable of withstanding high internal pressures, and which solves the problem of recycling by using the same material for the closure as for the container, nevertheless, one of the major problems in producing an all-plastic can remained; namely, the problem of producing a suitable opener, preferably of the easy-open type. Such an opener must be plastic, again for recycling purposes, must be easy to assemble to the lid for facilitating the manufacturing process, and must provide a reliable seal that will withstand internal pressures of 100–150 psi. In addition, the seal must be non-permeable to gas or liquid, yet must be easily openable by a relatively low pulling or tearing force. No satisfactory easy-open or pull-tab opener has previously been developed for use with plastic can closures, particularly ends made of PET or similar materials of the type disclosed in Ser. No. 824,983.

SUMMARY OF THE INVENTION

It is, therefore, an object of the present invention to provide an easy-opening, plug-type opener for a container closure, and particularly for a plastic closure constructed of a material such as PET.

It is a further object of the present invention to provide an easy-open closure for a beverage container, wherein the opener is capable of withstanding internal pressures of approximately 100 psi.

It is still another object to provide an easy-open pull-tab type of opener for the lid of a beverage container, wherein the lid and the opener are both capable of withstanding high internal pressures, yet are easily assembled, and easily opened.

Briefly, the present invention is directed to an easy-open feature for a beverage can, the easy-open feature being provided by means of a removable, or a tear-away, plastic closure plug secured within an opening formed in the closure, or container end, which is secured to the can. The container end, which preferably is plastic, includes a dispensing aperture either formed in the container end when it is molded, or thereafter cut in the end. The dispensing aperture, in one embodiment of the invention, is generally triangular in shape, with its apex at or near the axis of the container and its base adjacent the rim of the closure for easy dispensing of the contents of the can. In other embodiments, the aperture may be generally round or oval in shape.

In the first embodiment, the aperture is closed by means of a closure plug assembly having a top wall and a peripheral depending flange, the flange fitting snugly down into the aperture. The lower edge of the flange is deformed outwardly, as by swedging, under the edge of the aperture to hold the plug in place within the aperture. A sealing compound around the plug may be used to seal the peripheral edge thereof. Alternatively, the lower edge of the flange may be secured to the closure by a sonic welding operation which provides a continuous seal around the aperture and secures the plug against the high internal pressure which can be generated within the can by a carbonated beverage. Such sealing serves to prevent gas and liquid leakage from the container. The plug assembly carries a pull-tab which is shaped to permit the plug to be removed from the aperture when the contents of the can are to be used. The tab is formed as an integral part of the plug, in the preferred form, and when lifted upwardly serves to pull the plug out of the aperture. Preferably, the tab is connected to the plug so as to concentrate the initial pulling force at the apex of the plug so that the plug removal is started at a small area, thereby facilitating removal.

At least one pressure release pin is formed on the bottom surface of the pull tab for the plug, the pin extending through a venting aperture in the lid at a location adjacent the dispensing aperture. The release pin is heat sealed in place to prevent leakage, but is pulled out of the lid when the pull tab is lifted, in order to vent the gas pressure within the can prior to removal of the plug.

The plug and its lift tab are fastened to the lid by means of a stake and tether, so that when the plug has been removed from the aperture, the plug and lift tab assembly will remain connected to the can. This prevents the easy-open plug assembly from being discarded separately from the can, thus reducing litter and environmental problems.

In a second embodiment of the invention, the aperture in the container end is closed by means of a plug having a depending peripheral flange which engages the peripheral edge of a generally circular dispensing aperture in the container end. The exterior surface of the depending flange contains a locking groove which receives the edge of the dispensing aperture and holds the plug loosely in place. The plug is then sealed by means of a locking wedge located on the interior of the plug and pressed tightly into engagement with the interior surface of the peripheral flange, forcing the flange radially outwardly and into intimate engagement with the surrounding peripheral edge of the aperture. The wedge plug is used with carbonated beverage cans so that the pressure within the can tends to hold the plug in place and maintain the seal. Thus, the higher the interior pressure, the better the peripheral seal for the container. The plug is removed for dispensing the contents of the can by means of a vent plunger formed on the plug and extending through an aperture in the center of the closure plug. The pressure of the plunger forces the wedge down and away from its contact with its closure plug, venting the interior of the container to release the pressure and at the same time releasing the outward pressure on the side walls of the closure plug. This allows the plug to be removed from the container end dispensing aperture by pulling upwardly on a pull ring attached to the closure plug.

In a third embodiment of the invention, the dispensing aperture in the closure end is closed by means of an internal "bayonet" plug which engages bayonet-type threads formed in the top wall of the container end. With this construction, the container can be opened by a simple twist of the bayonet-type closure which allows it to be lifted up and out of the dispensing aperture. A modification of this embodiment provides an external bayonet closure wherein a cap engages exterior bayonet threads on the exterior surface of a pouring spout formed on the container end.

A still further modification of the invention is directed to a closure plug which is generally dome-shaped in a concave direction upon insertion into a dispensing aperture in a container end. The plug includes a peripheral groove which engages the aperture edge sufficiently to hold it in place and to seal it against low pressures, but it is not a high-pressure sealing engagement. Pressure generated within the can due, for example, to a carbonated beverage contained in the can, causes the plug to be forced outwardly until a pressure is reached at which the dome reverses from a concave direction toward a flat or slightly convex direction. This shift in the dome shape causes the plug to expand radially outwardly against the side edges of the aperture to produce a tight seal between the plug and the container end. The plug preferably is secured to the container end by means of a tether connected to a venting plug so that removal of the closure plug can be accomplished by pulling on the tether to vent the can. This causes the dome shape of the plug to revert to its original concave condition, loosening the plug within the aperture so that it can be removed by pulling upwardly on the tether strap.

A modification of the reverse dome plug embodiment involves the provision of a disk-shaped closure plug which extends completely across the container mouth and engages a peripheral groove on a container closure rim. The disk is normally curved downwardly in a concave direction, so that it is easily placed in the retaining groove. Pressure buildup within the container causes the curvature of the disk to reverse toward a flat or slightly convex direction, causing the disk to expand in a radial direction against the rim edge of the container closure to thereby seal the container. A pull tab and attached vent plug are provided on the disk, so that the container can be opened by venting the container to cause the dome to revert to its original shape, thereby allowing the disk to be pulled out of the container mouth by means of a pull tab.

The various embodiments described above provide reliable and inexpensive easy-open features for container end closures and particularly for plastic ends which are used in combination with plastic cans or other containers. The plug-type closures all function to reliably close and seal a dispensing aperture formed in the top wall of a container end, while at the same time providing a reliable and easy way to remove the plug closures to permit dispensing of the container contents.

BRIEF DESCRIPTION OF THE DRAWINGS

The foregoing, and additional objects, features and advantages of the present invention will become apparent to those of skill in the art from a consideration of the accompanying detailed description of preferred embodiments thereof, taken in conjunction with the accompanying drawings, in which:

FIG. 12 is a perspective view of the device of FIG. 9, showing the removal of the plug closure;

FIG. 13 is a top perspective view of a third embodiment of the invention, showing an internal bayonet-type closure;

FIG. 14 is a cross-sectional view of the device of FIG. 13, taken along line 14—14;

FIG. 18 is a top perspective view of a fourth embodiment of the invention, showing an external bayonet closure mounted on a container end;

FIG. 19 is a cross-sectional view taken long 19—19 of FIG. 18;

FIG. 20 is a bottom view of the closure of FIG. 18;

FIG. 21 is a side view partially cut away of the container end and external bayonet assembly of FIG. 18 with the bayonet cap removed from its dispensing spout;

FIG. 22 is an enlarged partial view of a modified form of FIG. 19;

DESCRIPTION OF PREFERRED EMBODIMENTS

Figure 1:
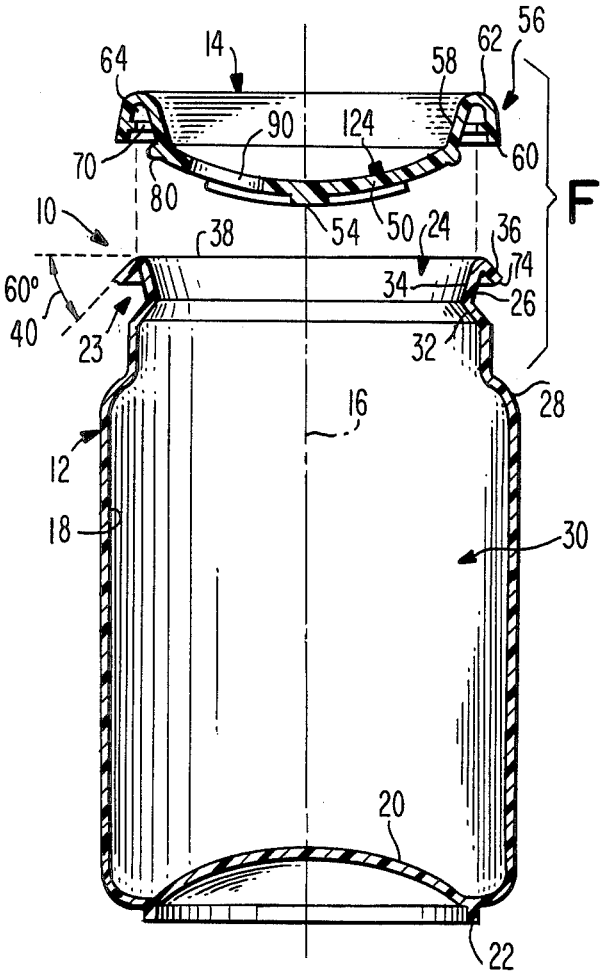
FIG. 1 is a cross-sectional exploded side view of an all-plastic can having a plastic container body and a plastic lid with a pouring aperture.

Turning now to a more detailed consideration of the present invention, there is generally indicated at 10 in FIG. 1 a plastic can which includes a plastic container 12 and a cooperating plastic container end, or closure, 14 which is shaped to fit over and firmly engage the top edge of container 12. The plastic can may take a variety of shapes, but preferably is generally cylindrical, with a vertical axis 16 and a cylindrical side wall 18. The container is constructed of PET, in the preferred form, and may be formed in a conventional manner, as by extrusion or injection molding. The container may have a nominal diameter of about $2\frac{3}{8}$ inch and a height of about 5 inches with a wall thickness of about 0.017 inch, in one form of the invention. The bottom of the container is closed by a unitary bottom wall 20 which is in spherical shape to form a concave dome. A stacking ring 22 is formed on the exterior of the container 12 at the juncture between the side wall 18 and the bottom wall 20.

The upper end of the container includes a neck portion 23 formed with a tapered mouth 24 which includes an outwardly flared neck segment 26 unitarily formed with the side wall 18. The neck portion 23 may be shaped in a variety of ways, but as shown is sloped inwardly at 28 from the main cylindrical body portion 30 of the can and is further tapered inwardly at 32 to meet with the bottom of the neck segment 26 to form an inwardly extending ridge 34. The ridge 34 and the neck segment 26 form the mouth 24 of the can.

Integrally formed with the top of neck segment 26 is an outwardly and downwardly extending locking flange 36 which meets the neck segment 26 at a top edge 38 of the can. Top edge 38 lies in a plane which is perpendicular to the axis 16 of the container, and the flange 36 is angled downwardly from the plane by an angle 40 which may be about 60° and preferably is between 60° and 70°. The flange 36 is of approximately the same thickness as the side wall 18, and thus is relatively flexible so that the flange will bend downwardly and inwardly upon application of the lid 14, but is sufficiently resilient to tend to return to the angle 40 so that a continuous outward pressure is exerted by the flange against the lid 14 when the container is assembled.

Figure 2:
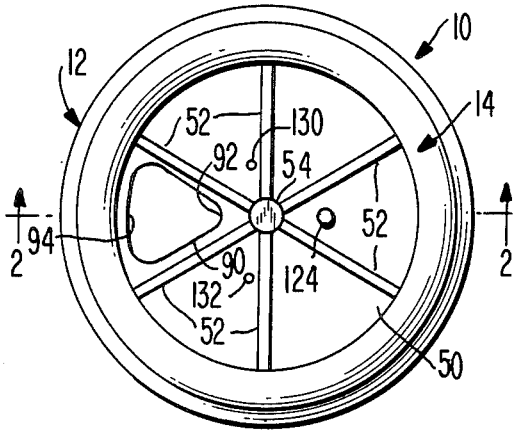
FIG. 2 is a top plan view of FIG. 1.

The closure 14 for the container is illustrated in cross-section in FIG. 1 and in a top plan view in FIG. 2. The closure is shaped to fit into the mouth 24 of the can 12 and to snap over the flange 36 to provide a secure, leak-proof seal for the can. The closure, or container end, 14 is of a plastic material, preferably the same material as can 12, and thus preferably of PET. The construction of the end 14 is such that it is relatively rigid with respect to the can, this being accomplished by a generally spherical or concave dome shape and by making it two to three times as thick as the can wall. The end 14 is formed in a conventional manner, as by injection molding, and includes a concave top wall 50 which is of a diameter to span the mouth 24 of the can 12 and thus to form a closure for the can when the lid is in place. The shape of the top wall 50 provides sufficient strength to resist internal pressures generated within the container by contents such as carbonated beverages, and for this purpose it preferably is reinforced by a plurality of ribs 52 formed in its bottom surface and radiating from a central hub 54.

Formed integrally with the top wall 50 is a peripheral, upstanding rim generally indicated at 56, the rim including an inner wall 58, an outer wall 60, and a bridging wall 62 which cooperates to form a downwardly facing groove 64 which is generally V-shaped in cross-section, and is shaped to receive the flared neck segment 26 and the flange 36 of can 12.

The rim portion 56 of container end 14 also includes an annular locking shoulder 70 which extends around the inner circumference of outer wall 60. This shoulder provides an upper edge which receives the lower, free edge 74 of flange 36 when the end 14 is fully engaged in the mouth of can 12. The shoulder 70 and flange 36 thus cooperate to provide a "snap-on" operation of the closure. The container end 14 also includes an annular bead 80 which extends circumferentially around the wall portion 50 at the junction of the wall with rim 56. The bead is on the exterior surface of the inner wall portion 58 of the rim, and is located to engage the lower edge of ridge 34 formed in the neck portion of can 12 to assist in the snap-on operation of the lid, to insure proper seating of the lid on the can, and to provide an improved seal when the container is subjected to internal pressure.

The closure 14 also incorporates a dispensing aperture 90 formed in the top wall 50, preferably, but not necessarily, between adjacent ribs 52, as illustrated in FIG. 2. This aperture preferably is formed in the lid during the molding step, but may also be produced by a suitable cutting operation after the lid has been formed. The aperture may be of any desired shape, and is generally triangular in this embodiment of the invention, with its apex 92 adjacent the central axis 16 of the container and closure and its base 94 being adjacent the inner wall 58 of rim 56. In other embodiments, the aperture may be round, tear-drop, oval, or other suitable shapes.

Figure 3:
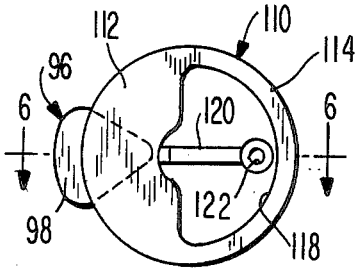
FIG. 3 is a top view of a closure plug and integral pull tab for the pouring aperture of the can of FIG. 1.
Figure 4:
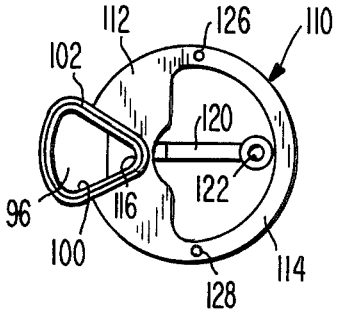
FIG. 4 is a bottom view of the closure plug of FIG. 3.
Figure 5:
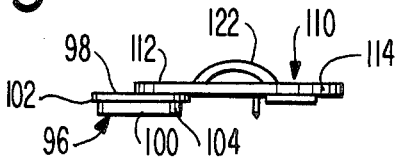
FIG. 5 is a side view of the closure plug of FIG. 3.

The aperture 90 is closed and sealed by means of a closure plug 96, illustrated in FIGS. 3, 4 and 5, the plug being shaped to fit snugly into the aperture 90 and to be secured in the aperture so as to withstand any high pressures generated within the can by its contents, yet being easily removable for access to the contents of the can. The plug 96 preferably is of the same material as the end 14 and shaped to the curvature of top wall 50, but alternatively may be of a plastic material more flexible than PET to enable the plug to conform to the curvature of the closure 14. The plug 96 includes a top wall 98 that is slightly larger than the aperture 90 so that when the plug is in place, the top wall covers the aperture. Depending from the bottom surface of top wall 98 is a continuous, peripheral flange 100 which snugly fits into the aperture 90, extending downwardly through the aperture in the manner illustrated in FIG. 6. Since the flange 100 fits into aperture 90, whereas the top wall 96 covers the aperture, the perimeter of the depending flange 100 is spaced inwardly a small amount from the edge of wall 98, thereby providing a peripheral shoulder 102 which rests on the top surface of end wall 50.

Figure 6:
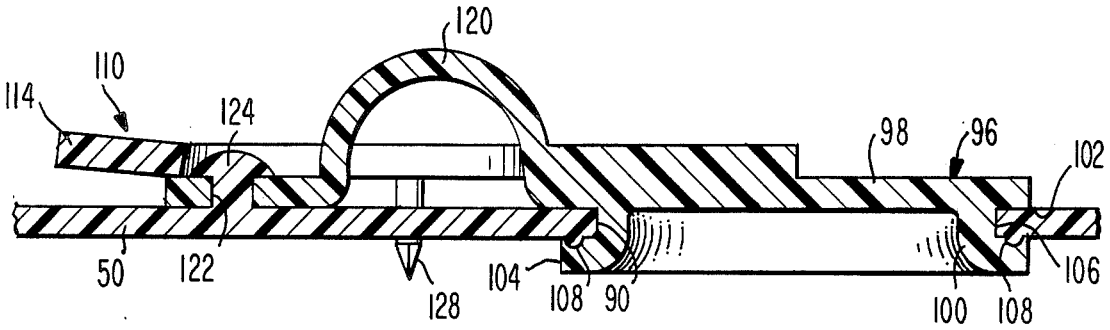
FIG. 6 is an enlarged cross-sectional view of FIG. 3, taken along lines 6—6 thereof, shown installed in a container lid.

As illustrated in FIG. 6, the bottom edge 104 of flange 100 is deformed outwardly, as by a swedging operation, to capture the edge of aperture 90 in a channel 106 formed between the upper peripheral shoulder 102 and the outwardly deformed, peripheral bottom edge 104 of plug 96, thereby holding the plug in the aperture. The swedging operation is continuous around the periphery of aperture 90, the bottom portion 104 being deformed sufficiently far to ensure that the plug is capable of withstanding the pressures of about 100–150 psi that are often generated within a carbonated beverage can, while permitting the plug to be removed when the container is to be opened.

The space between the aperture 90 and the plug 96 may be sealed sufficiently by the swedging operation to retain the contents of the container 12 if the contents are not under high pressure. However, for carbonated beverages or the like, or to insure a more reliable seal for non-carbonated beverages such as fruit juices or the like, a pressure seal may be provided between the plug and the container end top wall 50. This seal may be in the form of a gasket such as a sealing bead 108 formed around the periphery of aperture 90 and engaged by the outwardly deformed bottom edge 104 of the plug. Alternatively, or in addition, a sealing bead, O-ring, or other sealing material can be placed between the top surface of wall 50 and shoulder 102 of the plug 96. An improved sealing engagement between the plug 96 and the edge of aperture 90 can be provided by forming the plug 96 to be slightly dome-shaped in a concave direction (toward the interior of the container) with respect to the wall 50 so that pressure which builds up within the interior of the container will press against the interior of the plug and tend to flatten it out. This flattening pressure will tend to expand the plug radially toward the peripheral edge of aperture 90 to produce a tight seal around the edge of the plug.

Removal of the plug 96 for access to the contents of the can 10 is accomplished by means of a pull tab generally indicated at 110. The pull tab 110 preferably is molded integrally with the plug 96, but may be secured in alternative ways to the upper surface thereof. The pull tab may take a variety of forms, but essentially includes a lever portion 112 which is connected to the plug 96 and a lift ring portion 114 which is secured to the lever 112 and which is grasped by the user to pry up the lever portion to remove the plug from the aperture 90. In the form of the invention illustrated in FIGS. 3–6, the lever portion 112 preferably is secured at the apex end 116 of the plug so that when the lift ring 114 is raised, the lever portion 112 will tend first to pull the small, apex end of the plug upwardly and out of the apex 92 of the aperture, thereby reducing the initial force required to break the plug away from the container end 14. The lever portion 112 preferably covers part of the plug 96 so that raising of the lift ring 114 causes a pivotal motion of the plug 96, providing a lever action which twists the plug and enables it to be removed from the aperture with a minimal amount of lifting force.

In the illustration of FIGS. 3–6, the pull tab 110 is generally circular, with the lever portion 112 comprising a little less than one-half the area of the circle and the remainder of the circle having a cut out portion 118 which defines the lift ring portion 114 of the pull tab.

In the preferred form of the invention, the pull tab is secured to the closure 14 by means of a tether 120 which is in the form of a plastic strap integrally molded with the pull tab and secured at the center thereof. The tether includes an aperture 122 at the free end thereof which receives a stake 124 formed in the surface of the closure 14. As illustrated in FIG. 6, the stake 124 passes through aperture 122 and is spread outwardly to form a head over the tether, thereby securing the pull tab 110 to the closure. The tether is sufficiently long to allow free motion of the lift ring 114 and removal of plug 96, but secures the pull tab to the container so that it will not be separately discarded, but will be recycled with the remainder of the container.

One or more pressure release pins such as those shown at 126 and 128 may be provided on the pull tab 110. Preferably, these pins are located on the lift ring 114 and extend downwardly through corresponding apertures 130 and 132 in the lid where their ends are heated and deformed to seal the apertures. Pins 126 and 128 serve to release the pressure within the container when the container is to be opened, lifting of the ring portion 114 serving to pull the pins out of their apertures to release the pressure before the plug portion 96 is removed from aperture 90.

The pressure release pins 126 and 128 are primarily used with containers whose contents are under pressure so that the container is vented before the plug is removed. Such venting is a safety feature which prevents the plug from being forcibly ejected from the aperture as soon as it is loosened. Furthermore, the venting is particularly helpful in the removal of dome-shaped closure plugs which are pressed upwardly by the pressure to seal the plug in the aperture. Releasing the pressure returns the plug to its original shape to facilitate its removal.

In a preferred form of the invention, the plug 96 and the pull tab 110 are molded from the same material as the container end 14, and thus preferably are of PET. This provides a single-material container which facilitates recyclability. However, where recycling of the container is not required, a material other than PET can be used for the plug and/or for the pull tab, allowing for greater flexibility in the plug, and consequently facilitating its removal. A high density polypropylene would be suitable.

A further advantage of a dome-shaped plug which reverses its curvature under pressure is that the plug itself provides tamper evidence, for as long as the contents of the container are under pressure, the plug will be flat or curved slightly upwardly in a convex shape. However, when the pressure is released, the plug reverts to its concave shape, and provides evidence of that loss of pressure. Although such a reverse-dome sealing arrangement can be used with the generally triangular opening illustrated in FIG. 2, a circular opening is preferred.

In operation, the plug 96 is placed in the aperture 90 and the lower edge 104 is deformed, as by swedging, to hold the plug in position, and to close aperture 90. If required, gaskets or other seals are provided to seal the aperture against leakage of fluids such as the gas produced by carbonated beverages or the like within container 12. The release pins 126 and 128 are, at the same time, inserted into their corresponding apertures 130 and 132 and also are deformed to complete the sealing of the container. The pull tab 110 formed on plug 98 lies on the surface of the closure 14, is held down by pins 126 and 128, and is tethered to the lid by means of tether 120 and stake 124. When it is desired to open the container, the lift ring portion 114 of the pull tab is pivoted upwardly, pulling the release pins 126 and 128 out of apertures 130 and 132, respectively, to release any built-up pressure within the container. Further upward movement of the lift ring 114 causes the plug portion to begin to pivot upwardly at its apex 116, and begins to pull the plug out of the aperture 90. This is accompanied by a deflection or a partial shearing of the outwardly deformed portion 104 of the flange 100 so it is important that the deformation be limited to that which is necessary to hold the plug closure in place during handling and storage of the container. Because the break begins at the apex 116, the force produced by the upward motion of the lever portion 112 is concentrated in a small area, so that a relatively small pulling force on the lift ring 114 will serve to break the plug loose. Once the breaking away has been initiated, a continued upward pressure on the pull tab will remove the entire plug from the aperture, thereby opening the container. Since some of the outwardly turned portion 104, is deformed or torn away during removal of the plug, the plug can then be reinserted in the aperture to reclose the container.

Figure 7:
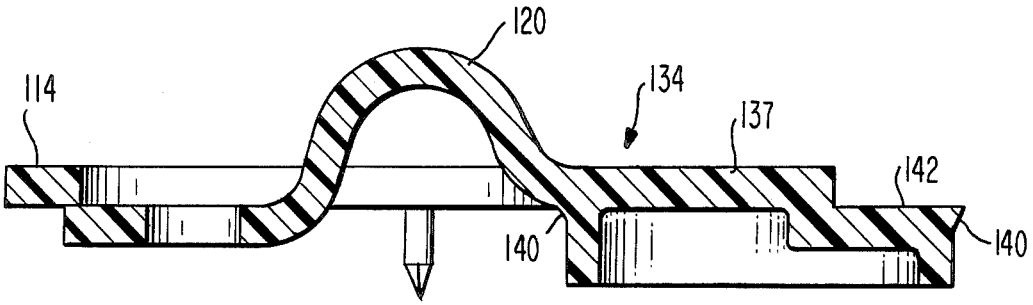
FIG. 7 is a cross-sectional view of a first modification of the closure plug and integral pull tab of the present invention.
Figure 8:
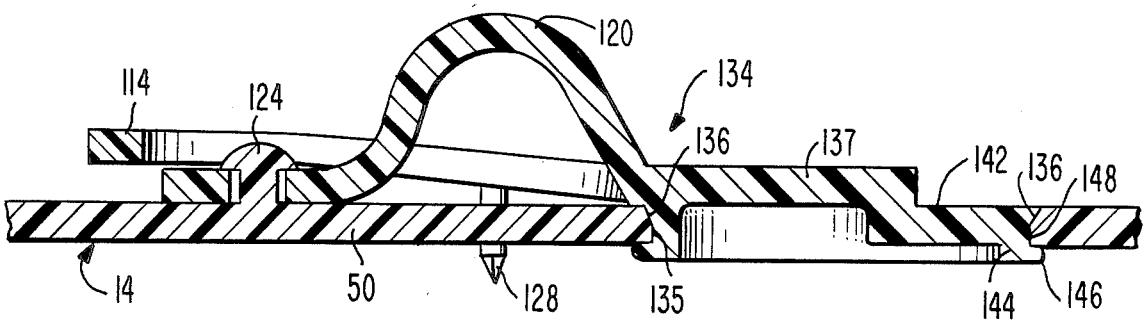
FIG. 8 illustrates the device of FIG. 7 installed in a container lid.
Figure 9:
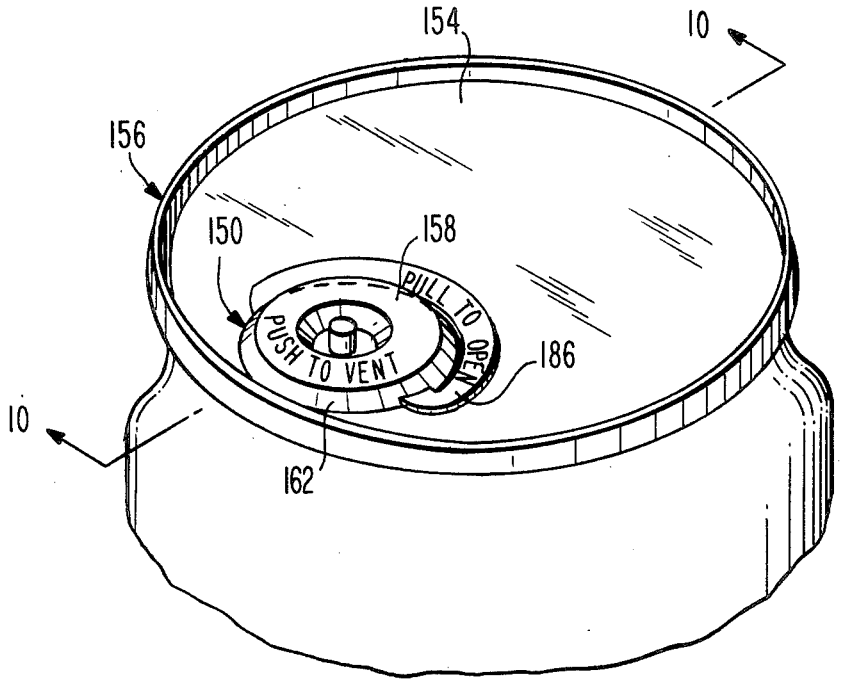
FIG. 9 is a top perspective view of a second embodiment of the present invention, utilizing a wedge lock arrangement.
Figure 10:
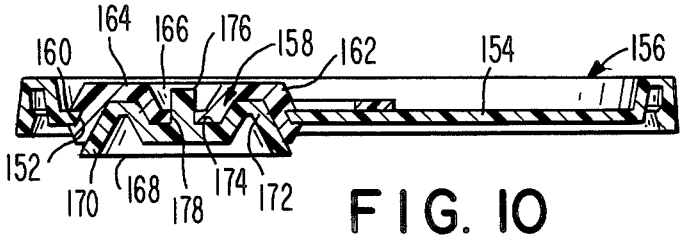
FIG. 10 is a cross-sectional view of the wedge lock plug closure, taken along line 10—10 of FIG. 9.

FIG. 7 shows a modified closure plug 134 and FIG. 8 shows that plug in place within an aperture 135 formed in the wall portion 50 of container end 14. The aperture 135 is similar to that illustrated in FIG. 6, except that the top surface of wall 50 at the edge of the aperture is tapered outwardly at 136 so that the aperture is larger at the upper surface of the wall 50 than at the lower surface thereof. The plug portion 137 of the closure plug 134 is formed with a tapered shoulder 140 (FIG. 7) in place of the shoulder 102 illustrated in FIGS. 4, 5 and 6, so that the top surface 142 of the plug portion 137 lies flush with the top surface of the wall 50, as shown in FIG. 8. The plug 137 includes a depending peripheral flange 144 which is inserted into the aperture 135 and is deformed outwardly, as at 146, by swedging to secure the plug in the aperture. The shoulder portion 140 and the deformed portion 146 define a tapered channel 148 which engages the periphery of the aperture 135 to secure the plug in place.

The closure plug 134 includes a tether 120 and a lift ring portion 114 as previously described with respect to FIG. 6.

Turning now to a consideration of FIGS. 9–12, there is illustrated a second embodiment of the present invention wherein a closure plug 150 is illustrated as being mounted in an aperture 152 formed in the top wall 154 of a container end, or closure, generally indicated at 156. Although shown as being relatively flat, the top wall 154 may be slightly dome-shaped, or concave, in the manner of the closure illustrated in the preceding figures. In this embodiment, the closure plug is a two-part assembly which consists of a first or upper plug portion 158 which is mounted in the aperture 152. The aperture 152 preferably is round, as is the plug 158, although the aperture and plug may take other shapes. The plug 158 is secured in the aperture by means of a peripheral groove 160 formed in the generally outwardly sloping side wall 162.

The top wall 164 of plug portion 158 includes, in the preferred form, a central depression 166 so that in cross-section, the plug 158 is generally in the form of an inverted W.

The second part of the plug assembly 150 is an inner, or lower, sealing wedge 168 which includes an outwardly tapered peripheral wall 170 shaped to intimately engage the inner surface of the wall 162 of the plug 158. The wedge also includes a top wall 172 and a central depression 174 which conform to the lower surfaces of the top wall 164 and the depression 166 formed in plug 158 so that the wedge 168 forms, in cross-section, an inverted W and is capable of being pressed into intimate engagement with the lower surface of plug 158. However, the outer diameter of sealing wedge 168 is slightly larger than the diameter of the inner surface of plug 158 so that when the wedge is pressed upwardly into engagement with the inner surface of the plug 158, the wedge tends to spread the outer wall 162 of the plug radially outwardly. This radial spreading of the plug 168 presses the groove 160 tightly against the edge wall of the aperture 152 to provide a sealing engagement. The sealing wedge 168 thereby locks the plug 158 into the aperture 152 to prevent leakage around the plug assembly. The wedge-locked plug assembly 150 is particularly applicable to pressurized containers, since the internal pressure within the container will tend to press the sealing wedge 168 into engagement with the plug 168, and the higher the pressure, the better the seal.

Figure 11:
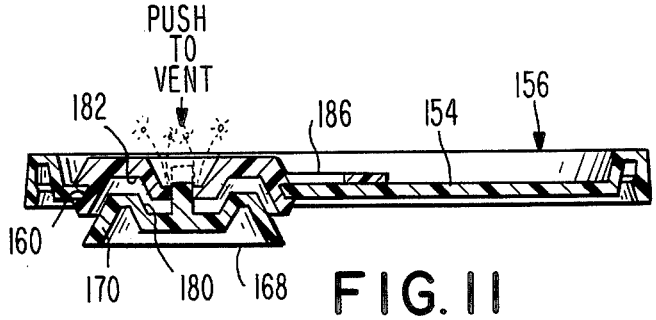
FIG. 11 is a cross-sectional view taken along line 10—10 of FIG. 9 and showing the venting operation of the wedge lock closure.

In a preferred form of the invention, the sealing wedge 168 includes a central vent plunger 176 which extends up through a central aperture 178 formed in the middle of the depressed area 166 of plug 158. The plunger provides a pressure release for the closure plug 150, for use when the container is to be opened. Pressure on the plunger 176 pushes the sealing wedge 168 downwardly, as illustrated in FIG. 11, to allow pressurized gas to escape through aperture 178, around the plunger 176. The release of the gas pressure allows the exterior surface 180 of the sealing wedge 168 to remain separated from the interior surface 182 of the plug 158, even after the plunger 176 is released, thereby relieving the radially outward pressure against the side wall 162. This pressure release then allows the plunger assembly 150 to be removed from the aperture 152, as by means of a pull ring 186 secured to the plug 158, illustrated in FIG. 12. If desired, the vent plunger may be provided with an enlarged head portion on the end of plunger 176 to keep the wedge attached to plug 158. Alternatively, the plunger can be pushed completely through the aperture 178 separating the two parts of the closure plug.

A third embodiment of the invention is illustrated in FIGS. 13–17, to which reference is now made. In this embodiment, the closure plug is generally indicated at 190 and, as in the previous embodiments, is mounted in an aperture formed in the top wall 192 of a container end, or closure, generally indicated at 194. Again, the closure 194 may be similar to that illustrated in the embodiment of FIG. 1 and is mounted on a container 196 such as a plastic can. The closure plug 190 includes an internal bayonet-type thread which is adapted to engage a generally circular aperture 198 (FIG. 17) formed in wall 192. As there shown, the aperture 198 includes a pair of diametrically opposed bayonet cutouts 200 and 202 which extend radially outwardly beyond the aperture walls and which receive a pair of corresponding outwardly extending bayonet flanges on the closure plug 190, to be described. The flanges fit downwardly through the cutouts 200 and 202, and upon rotation of the plug, the flanges pass under the adjacent wall areas 204 and 206 of aperture 198 to lock the plug in place.

Plug 190 includes a top wall 210 which is generally circular in shape and which overlies the aperture 198. An annular wall 212 depends from the lower surface of top wall 210 and is sized to fit snugly through the aperture 198. At the bottom edge of wall 212 are two outwardly extending, diametrically opposed bayonet connector flanges 214 and 216 which are shaped and sized to fit through the cutouts 200 and 202, respectively. The flanges are spaced below the bottom surface of top wall 210 by a distance equal to the thickness of top wall 192 so that when the plug 190 is placed in aperture 198, the flanges 214 and 216 will pass through the cutouts 200 and 202 and upon rotation of the plug, will pass under the wall 192 at 204 and 206 to firmly hold the plug in place. The flanges 214 and 216 extend sufficiently far under the wall 192 to secure the plug against removal by any pressures generated within the container, but allow easy removal of the plug when the plug is rotated to its original orientation with respect to the aperture 198.

Insertion and removal of the plug 190 is accomplished by means of a handle 218 integrally formed on the top wall 210 of the plug. This handle may take many forms, but is illustrated as a vertical ridge extending diametrically across the top wall 210. This handle is of sufficient height to permit easy grasping of the plug for removal and insertion of the closure plug.

Figure 17:
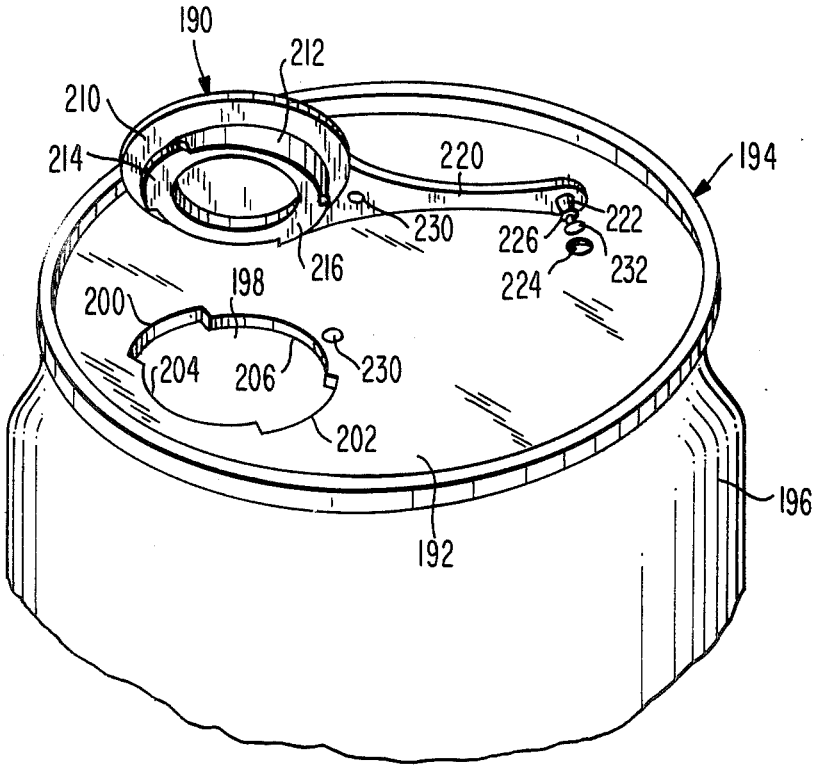
FIG. 17 is a top perspective view of the device of FIG. 13, showing the internal bayonet closure removed from the dispensing aperture of the container end.

Plug 190 preferably is secured to the container end 194 by means of a tether 220 which is flexible and which is sufficiently long to permit easy rotation of the closure plug. The tether may be formed integrally with the closure plug 190. The free end of the tether is secured to the top wall 192 by means of a vent plug 222 which passes through and is secured in a vent aperture 224 (FIG. 17). As illustrated in FIG. 14, the vent plug 222 fits snugly into the aperture 224 and is secured in the aperture by a bead 226 which seals the aperture against leakage due to pressure buildup within the container. A tamper-evident weld spot 230 is provided on the tether 220 adjacent the wall 210 of the closure plug. This weld spot, which may be produced by sonic welding, tacks the tether onto the top wall 192 of the container end to prevent unintentional rotation of the closure plug. Any movement of the plug will break this sonic weld to provide evidence of such movement.

To seal the container, a closure plug 190 is inserted into the aperture 198 and twisted approximately 90 degrees to a locked position, as illustrated in FIG. 14. The vent plug 222 is then placed in the vent aperture 224. The sealing bead 226 may be formed prior to insertion of the vent plug and may be of a soft enough material to effectively seal the small aperture 224. However, as an alternative, the sealing bead may be formed after the plug is in place in aperture 224 and may be a sonic weld, if desired. If such a weld is necessary, it is formed before the end 194 is placed on container 196.

Figure 15:
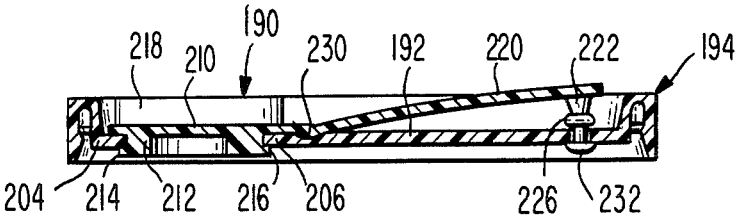
FIG. 15 is a cross-sectional view taken along line 14—14 of FIG. 13, showing the venting of the internal bayonet closure.
Figure 16:
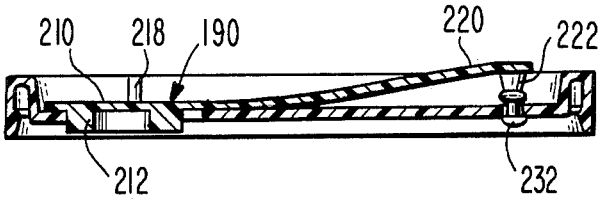
FIG. 16 is a cross-sectional view taken along line 14—14 of FIG. 13, showing the rotation of the bayonet closure to the open position.

A container closed and sealed by means of the bayonet closure plug 190 is opened by first lifting the tether 220 to pull the vent plug 222 out of aperture 224, as illustrated in FIG. 15. The plug 222 incorporates a retainer 232 which prevents the vent plug from being pulled all the way out of aperture 224 but which allows the passage of pressurized gas from within the container to pass around the retainer and out the aperture 224 to vent the interior of the can. Further lifting of the tether 220 will break away the tamper-evident heat seal 230 to allow the plug 190 to be rotated within aperture 198 to align the bayonet connector flanges 214 and 216 with the cutouts 200 and 202, thereby permitting removal of the plug and dispensing of the fluid within the container. The plug 190 can be replaced and the container sealed by reversing this process, thereby providing a resealable closure for the container end 194.

As with the prior embodiments, additional sealing may be provided around the aperture 198, if desired, as by means of a gasket such as a sealing rim, a raised bead around the aperture, a bead and groove arrangement, or a bead engaged by sealing flanges of the type described in U.S. Pat. No. 4,143,785 to Joseph C. Ferrell.

A fourth embodiment of the present invention is illustrated in FIGS. 18–21, wherein an external bayonet closure 240 is provided on an end closure 242 of a container 244. The closure 240 includes a closure cap 246 having a top wall 248 and a depending, peripheral side wall 250. The cap fits over, and surrounds, a pouring spout 252 formed in the top wall 254 of the container end 242 and defines a dispensing aperture 256. The cap 246 includes a pair of diametrically opposed bayonet connector flanges 258 and 260 which extend radially inwardly toward the center of the cap to form bayonet-type threads for securing the cap to exterior locator threads 262 and 264 formed on the outer surface of pouring spout 252. As illustrated in FIG. 21, the exterior connector threads are stepped, as at 266, to enable the cap to be removed in stages, thereby allowing the cap itself to vent the container before it is fully removed. Alternatively, or in addition, a vent plug 268 may be connected to closure 240 by means of a tether 270 secured to the top of the cap wall 248 by means of a tether peg 272. The tether preferably is also secured to the top wall 248 of the cap by means of a spot weld 274 which provides tamper evidence for the cap.

The cap may be sealed to the top edge of the dispensing spout 252 by a suitable gasket such as the flanges 276 illustrated in FIG. 22, which flanges are of the type described in the aforesaid U.S. Pat. No. 4,143,785.

In operation, the container 244 is sealed by placing the external bayonet closure 240 over the dispensing spout 252 so that the bayonet flanges 258 and 260 pass between the external thread connectors 262 and 264. The closure 240 is then pressed downwardly and rotated in a clockwise direction, as viewed in FIG. 18, to engage the flanges 258 and 260 with the lowermost part of the external threads 262 and 264. The vent plug 268 is then placed in the corresponding aperture in wall 254 of the container end 242, the tamper-evident seal 274 is provided, as by sonic welding, to secure the tether 270 to the top of the cap 246, and the end 242 is then ready to be placed on the container. The container 244 is opened by breaking the tamper-evident seal 274, as by lifting up on the tether 270, and by either pulling up on the vent plug 268 or rotating the cap 246 a few degrees to allow the cap to move upwardly on the stepped teeth 266 and to vent the container. Thereafter, further rotation of the cap allows removal thereof.

Figure 23:
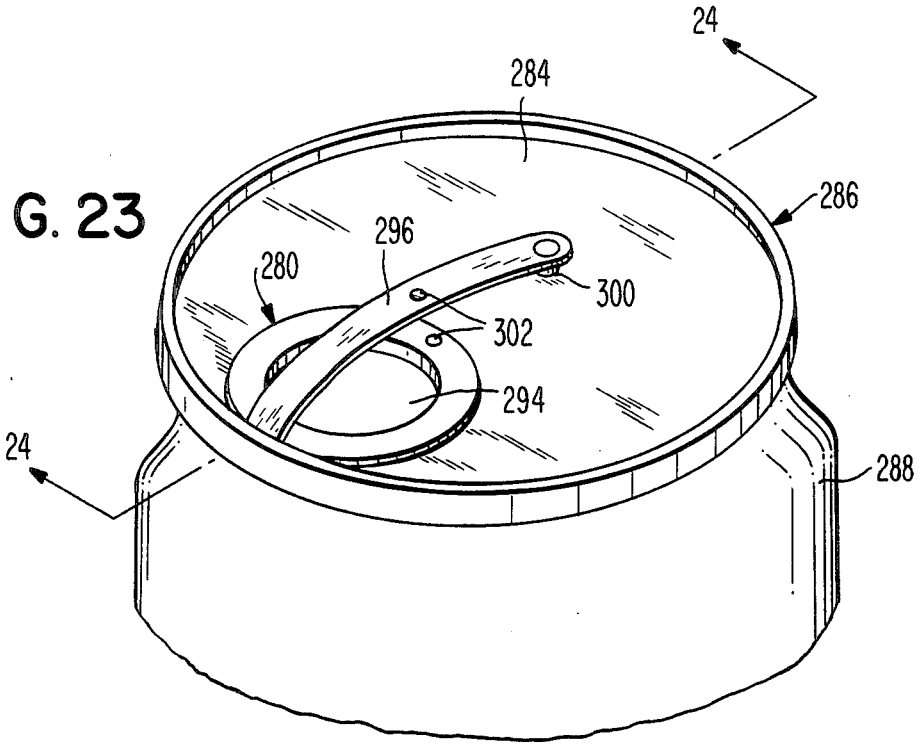
FIG. 23 discloses a fifth embodiment of the present invention, utilizing a reverse dome plug.

A fifth embodiment of the present invention is illustrated in FIG. 23, wherein a reverse dome closure plug 280 is illustrated. The plug 280 is inserted in an aperture 282 (FIG. 26) formed in the top wall 284 of a closure, or container end, 286. As in the previous embodiments, the closure 286 may be mounted on a suitable container 288 by any suitable means. Again, although the closure is shown as having a flat top wall 284, it will be understood that a concave wall may be provided, generally in the manner of FIG. 1.

Figure 24:
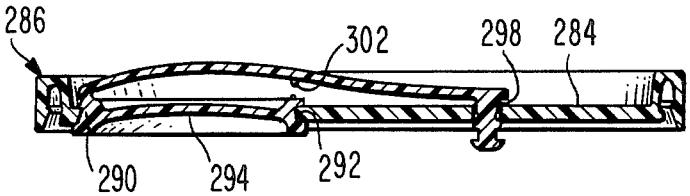
FIG. 24 is a cross-sectional view taken along line 24—24 of FIG. 23.
Figure 26:
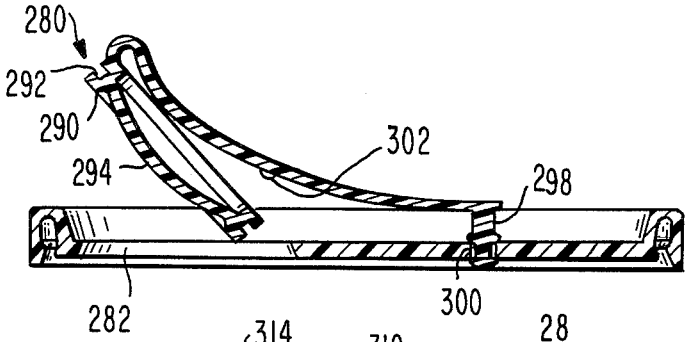
FIG. 26 is a cross-sectional view taken along line 24—24 of FIG. 23, showing the reverse dome plug removed from the dispensing aperture formed in the container end.
Figure 27:
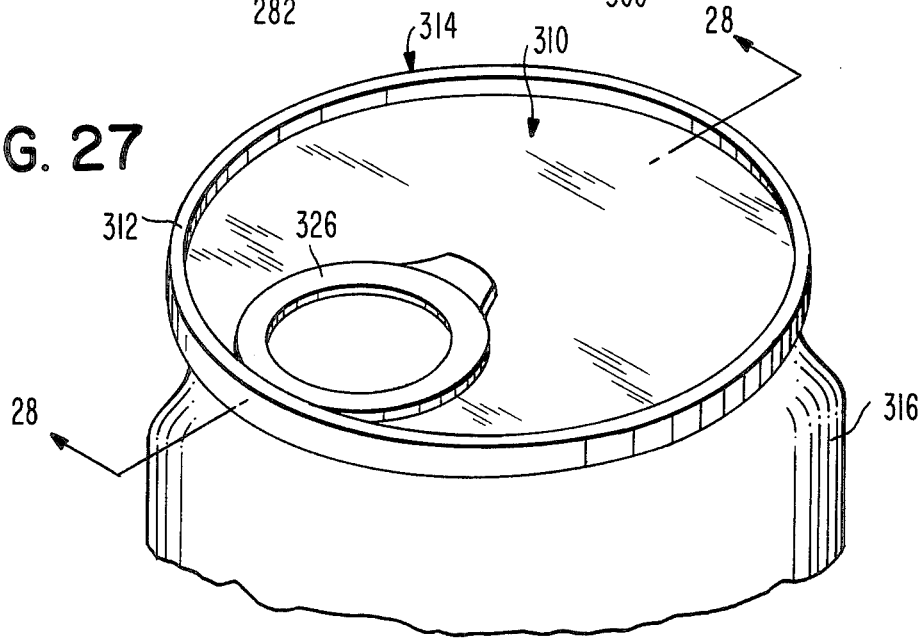
FIG. 27 discloses a sixth embodiment of the present invention utilizing a disk-shaped closure plug with reverse dome sealing.

Plug 280 consists of an annular vertical wall 290 having a peripheral outwardly facing groove 292 which receives and holds the periphery of circular aperture 282, as illustrated in FIG. 24. The center of the plug, within the wall 290, is closed by a central, dome-shaped wall 294 which normally has a concave shape, as shown in FIG. 26. The plug 280 is connected to the wall 284 by means of a tether 296 and a vent plug 298 passing through an aperture 300 formed in top wall 284, as described with respect to previous embodiments. The tether 296 is connected at one end to the wall 290 of the closure plug 280, with its opposite end being connected to the vent plug 298. If desired, the tether may be tacked to the top of wall 290 at a point diametrically opposite to the connection of the tether, as by means of a sonic weld generally indicated at 302, to provide a tamper-evident closure.

Figure 25:
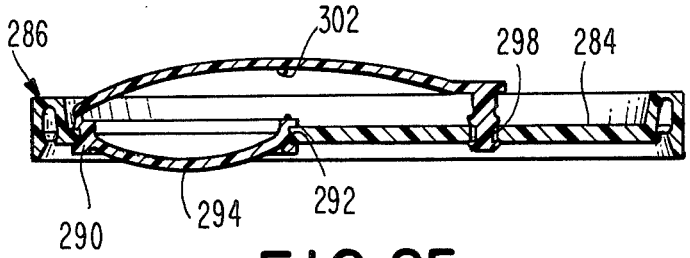
FIG. 25 is a cross-sectional view of the device of FIG. 23, showing the venting of the container.

To seal the top wall 284, the closure 280 is placed in aperture 282, with its annular groove 292 engaging the top wall 284 around the periphery of the aperture. The closure wall 294 is concave, as illustrated in FIGS. 25 and 26. The vent plug 298 is inserted into aperture 300 to seal that aperture, and if desired a tamper-evident weld spot 302 is formed to secure the tether to the plug 280. The container end 286 may then be placed on container 288 and sealed thereto. Interior pressure within the container will force the center wall 294 outwardly toward the position illustrated in FIG. 24, and this flexing of the center wall causes the surrounding wall 290 to be expanded radially outwardly against the peripheral edge of the aperture 282, thereby providing a secure, gas-tight seal around the aperture. If desired, suitable gaskets may be provided in the groove 292 to provide an initial seal that will permit a pressure buildup within the container to produce the firm seal which occurs when the curvature of the dome is reversed, as described above.

When the container is opened, it is first vented by pulling the vent plug out of aperture 300 by means of the tether 296, at the same time breaking the tamper-evident seal 302, as illustrated in FIG. 25. This allows the center wall 294 to revert to its original dome-shaped, concave position, loosening the contact between the groove 292 and the edge of aperture 282 and allowing the plug 282 to be pulled out of the aperture by means of tether 296 as illustrated in FIG. 26.

A sixth embodiment of the invention is illustrated in FIGS. 27 through 30. This embodiment is similar to that of FIG. 23, except that the plug extends diametrically across the entire closure so that the entire top wall of the container end is removed for dispensing purposes. Thus, the embodiment of FIG. 27 includes a reverse dome lid 310 which is mounted within the rim portion 312 of a container end closure 314. The rim 312 is adapted to receive the upper edge of a container 316, in the manner previously described, and also includes an inner sealing groove 318 which is formed around the inner surface of rim 312. Groove 318 receives a corresponding bead 320 formed around the periphery of lid 310. Formed just below the bead 320 on the lid is a second sealing groove 322 formed around the periphery of the lid and shaped to receive a lower sealing bead 324 formed on the interior of rim 312, just below groove 318. This double bead and groove arrangement provides a peripheral seal around the interior of rim 312 which holds the interior lid 310 in place and insures a secure seal against leakage of the contents of the container 316.

The lid 310 is normally in a downwardly curved, convexed shape before the container end 314 is placed on a container. However, upon application of the end to a container, pressure buildup within the container will cause the lid to reverse its direction of curvature, as illustrated in FIG. 28, thereby expanding the peripheral edge of the lid radially outwardly to increase the sealing force against rim 312.

Figure 28:
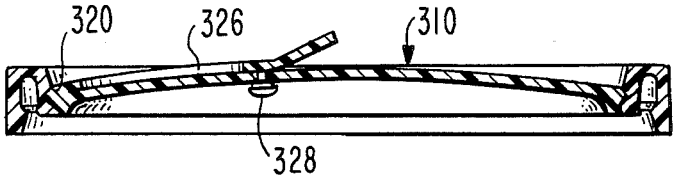
FIG. 28 is a cross-sectional view taken along line 28—28 of FIG. 27.
Figure 29:
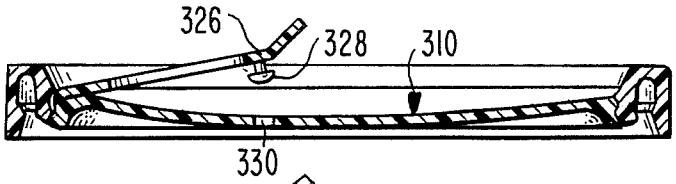
FIG. 29 is a cross-sectional view taken along line 28—28 of FIG. 27 and showing a venting operation.
Figure 30:
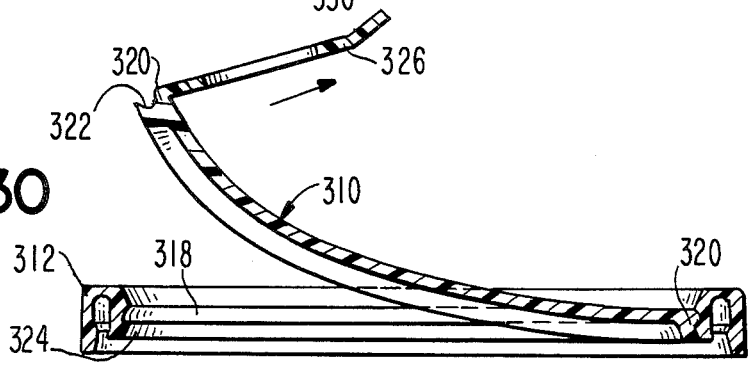
FIG. 30 is a cross-sectional view taken along line 28—28 of FIG. 27, showing the removal of the disk-type closure.

A pull ring 326 is formed integrally with the lid 310 at one edge thereof, is folded over the top surface of the lid, and is secured thereto by means of a vent plug 328, as shown in FIG. 28. Removal of lid 310 from the container is accomplished by pulling upwardly on the pull ring 326, thereby removing vent plug 328 from its corresponding aperture 330 to release the built-up pressure within the container. This causes the upwardly-curved lid 310 to revert back to its original concave shape, as illustrated in FIG. 29 so that a further pressure on the pull ring 326 will remove the lid completely from rim 312, as illustrated in FIG. 30.

Thus, the present invention has been illustrated in terms of a variety of embodiments, all of which are illustrative of plug-type closures for containers. Although the closures are particularly suited for containers which receive pressurized contents, and especially for all-plastic cans for carbonated beverages, or the like, it will be understood that the closures can be used with containers made by other materials and containing other products. As previously indicated, the pressures within the carbonated beverage can often rise as high as 100 psi or more, and it is extremely difficult to provide an easy-open closure configuration for such a container, for the need to retain the integrity of the closure under high pressure is, in many instances, inconsistent with the need to provide an easily operated opener for the container. The present invention, in its preferred form, provides easy opening features for such a container, and thus represents a significant step in the development of an all-plastic beverage container.

Although the present invention has been described in terms of preferred embodiments, it will be understood that numerous variations and modifications may be made without departing from the true spirit and scope thereof as set forth in the accompanying claims.

What is claimed is:

1. An easy-open closure for a container, comprising:

a container end having a top wall portion and means to engage a container;

a dispensing aperture in the top wall portion of said container end;

plug means shaped to snugly fit in said dispensing aperture, said plug means including (a) a central wall portion surrounded by a depending peripheral flange extending through and engaging the peripheral edge of said aperture, and (b) outwardly extending shoulder means engaging the top surface of said top wall, the peripheral edge of said dispensing aperture being clamped between said flange and said shoulder means to secure said plug against removal by internal pessure within a container closed by said container end;

lift tab means formed unitarily with said plug means, said lift tab means being adapted to remove at least part of said plug means from said dispensing aperture to permit opening of said dispensing aperture; and tether means secured to said plug means.

2. The easy open closure of claim 1, further including release pin means formed on said lift tab and extending through said top wall to release pressure within a container prior to removal of said part of said plug means.

3. The easy-open closure of claim 2, wherein said lift tab is secured to said plug means so as to remove all of said plug from a lid aperture.

4. An easy-open closure for a dispensing aperture formed in a container end for a pressurized container, comprising:

a container end having a top wall including a dispensing aperture;

plug means shaped to snugly fit in said dispensing aperture, said plug means including a peripheral side wall and a central flexible concave wall integrally formed with said peripheral side wall, an exterior groove on said side wall, said groove receiving the peripheral edge of said aperture, said side wall being forced radially outwardly by upward flexure of said central wall due to pressure within a container to which said container end is affixed, the radially outward motion of said side wall providing a sealing contact between said groove and said peripheral edge of said aperture.

5. The easy-open closure of claim 4, further including tether means secured between said plug and said container end.

6. The easy-open closure of claim 4, further including vent plug means in said container end for releasing pressure within a container to allow said plug to return to its initial concave shape and to permit removal of said plug from said aperture.

7. The easy-open closure of claim 6, wherein said vent plug connects said tether to said container end.

8. The easy-open closure of claim 1, wherein said tether means comprises an elongated strap having a first strap end secured to said plug means and a second strap end secured to said container end adjacent said dispensing aperture.

9. The easy-open closure of claim 8 , wherein said tether means is integrally formed with said plug means.

10. The easy-open closure of claim 9, wherein said lift tab means comprises a ring extending outwardly from said plug means.

11. The easy-open closure of claim 1, wherein said outwardly extending shoulder means are integrally formed with, and form an extension of, said central wall portion, whereby said central wall and said shoulder means cooperate to cover said dispensing aperture.

12. The easy-open closure of claim 1, wherein said depending peripheral flange has an outwardly extending bottom edge which engages the bottom surface of said container end around at least a portion of the periphery of said dispensing aperture.

13. The easy-open closure of claim 12, further including sealing means between said flange and the peripheral edge of said dispensing aperture.

14. The easy-open closure of claim 13, wherein said sealing means comprises gasket means.

15. The easy-open closure of claim 1, wherein said container end is curved, and wherein said central wall portion of said plug means is shaped to match the curvature of said container end.

16. The easy-open closure of claim 1, wherein said plug means is concave with respect to said container end.

* * * * *